United States Patent [19]

Millman

[11] Patent Number: 4,680,439

[45] Date of Patent: Jul. 14, 1987

[54] PLASTIC MICROWAVE OVEN CAVITY

[75] Inventor: Ronald W. Millman, Bloomington, Minn.

[73] Assignee: Litton Systems, Inc., Beverly Hills, Calif.

[21] Appl. No.: 869,214

[22] Filed: May 30, 1986

[51] Int. Cl.[4] ..... H05B 6/64

[52] U.S. Cl. ..... 219/10.55 R; 219/10.55 D

[58] Field of Search ..... 126/19 R, 273 R; 219/10.55 R, 10.55 D

[56] References Cited

U.S. PATENT DOCUMENTS 4,385,082 5/1983 Eichelberger et al. ..... 427/105

4,563,559 1/1986 Enami ..... 219/10.55 D

OTHER PUBLICATIONS

Bond Coat Prepares Plastic for Metallizing—pp. 114 and 115, Design News 5-6-85.

TAFA Application Data file 2.4.3.12—Thick Zinc and Copper Zinc Coatings on Thin Plastic, Jan. 1979, one page.

TAFA Application Data File 2.4.3.11-30 Attenuation of TAFA Zink Coatings, Jan. 1979, 4 pgs.

TAFA Application Data file 2.4.3.13-Shielding Background Data, Apr. 1979, 2 pgs.

TAFA Technical Data File 1.9.4.4.2—TAFA Tiecoat—A Bond Coat for Plastics—11-1984, 6 pgs.

TAFA Application Data File 2.4.3.14.2—Typical Specification: TAFA Tiecoat/Arc Spray Metalized Zinc Coating on Plastic Substrates, Nov. 1984, 3 pgs.

Acheson Polymer Thick Film Inks Information Sheet, 23 pgs. no publication date.

*Primary Examiner*—Carroll B. Dority, Jr.

*Attorney, Agent, or Firm*—John Haurykiewicz; Walter R. Thiel

[57] ABSTRACT

A plastic microwave oven cavity assembly formed of top and bottom members having a microwave impermeable coating on the interior thereof and a side wall member having a microwave impermeable coacting on the exterior thereof with the members joined by seams which maintain the integrity of the microwave impermeable coacting to contain microwave energy within the cavity.

8 Claims, 6 Drawing Figures

PLASTIC MICROWAVE OVEN CAVITY

BACKGROUND OF THE INVENTION

In the past, it has been customary to form microwave oven cavities from sheet matal parts. The cavity of the microwave oven was typically made up of such sheet metal into a generally box-shaped structure having one side substantially open for access in inserting and retrieving food when the access door was open. Such sheet metal structures have been relatively expensive and difficult to manufacture. In addition, such structures usually required post-forming treatment such as painting to provide for an aesthetically pleasing interior surface which was at the same time required to be hygienic because microwave ovens are used to prepare food.

SUMMARY OF THE INVENTION

The present invention overcomes the shortcomings of the sheet metal microwave oven cavity construction by providing a plastic microwave oven cavity assembly formed of top and bottom members having a microwave impermeable coating on the interior thereof and a side wall member having a microwave impermeable coating on the exterior thereof with the members joined by seams which maintain the integrity of the microwave impermeable coating to contain microwave energy within the cavity.

A front wall also formed of coated plastic provides the access aperture and continues the microwave impermeable coating to the periphery of the access aperture.

DETAILED DESCRIPTION

Figure 1:
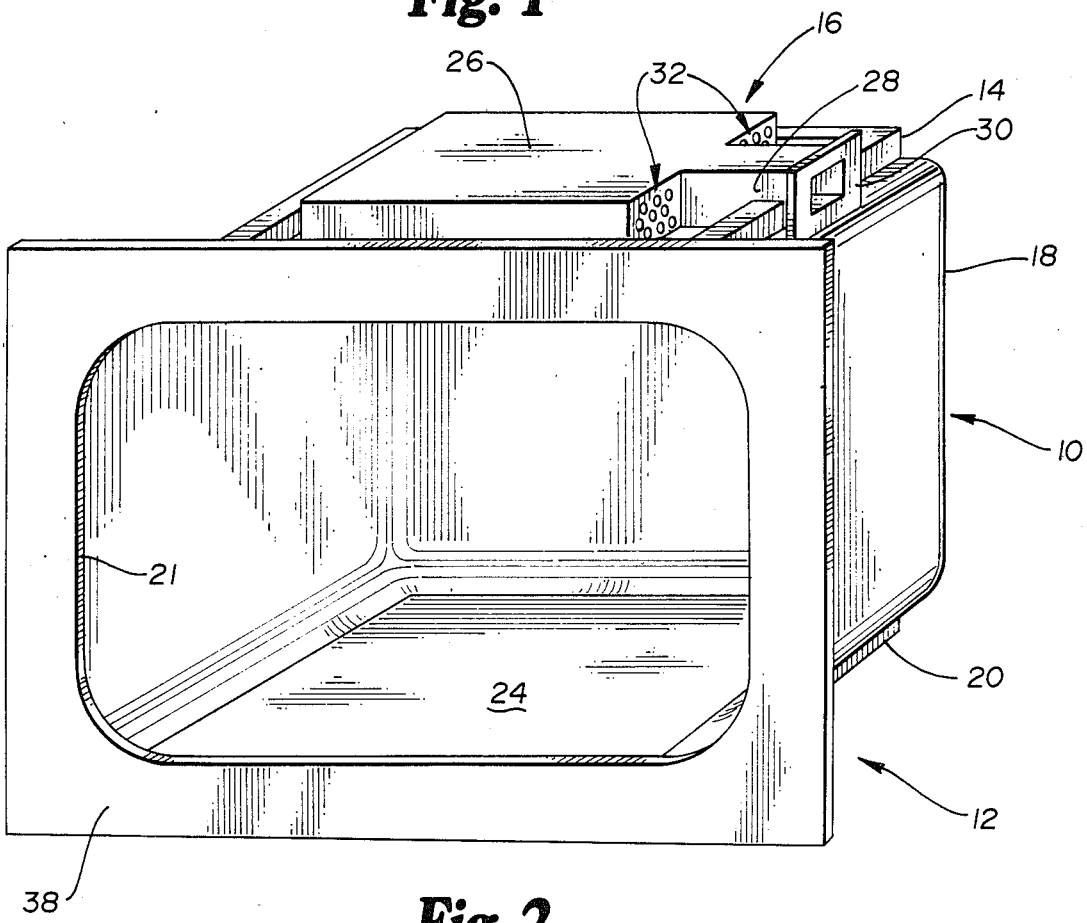
FIG. 1 shows a perspective view of the completed assembly of a microwave oven cavity, front panel and shelf.

Referring now more particularly to FIG. 1, a plastic microwave oven cavity 10 is shown assembled to a plastic microwave oven front panel 12. A seam 14 joins a generally pan-shaped top member 16 to a generally U-shaped side wall member 18.

A seam 20 joins side wall member 18 to a generally pan-shaped bottom member 22 (not visible in FIG. 1).

A shelf member 24 is provided to function as a floor of the microwave oven cooking cavity and is preferably made of microwave transparent material. Shelf 24 may be permanently affixed to cavity 10 or may be made removable.

Generally pan-shaped top member 16 preferably has a stirrer box 26 integrally formed therein. Although stirrer box 26 is shown in rectangular form in the figures, other shapes such as cylinders or arbitrary shapes may be found desirable.

Stirrer box 26 may have a waveguide or other microwave communication passageway 28 formed integrally therewith. Waveguide 28 may have a cross section other than rectangular if desired. A conventional waveguide flange 30 is shown at the end of waveguide 28, however, other configurations to couple the waveguide or other communication passageway for microwaves between the stirrer box and the source of microwave energy are contemplated. It may be found desirable to include one or more groups of apertures 32 in the feed box to provide passageways for air flow into or out of feedbox 26. Similarly, one or more aperture groups (not shown) may be included in side wall member 18 for communication of air or light to the interior of the cavity.

Figure 2:
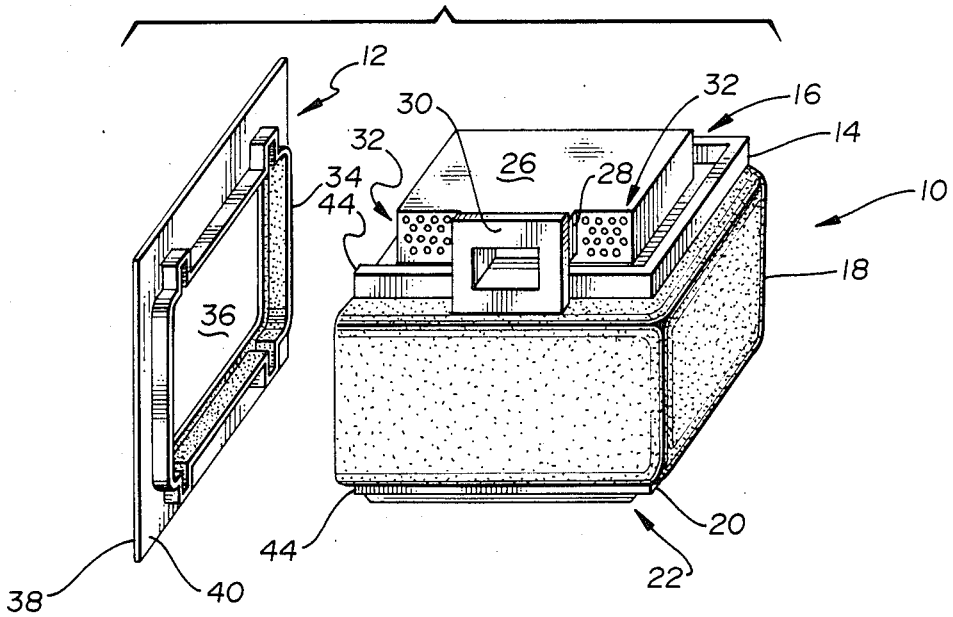
FIG. 2 shows a side perspective view of the cavity assembly with the front panel removed.
Figure 3:
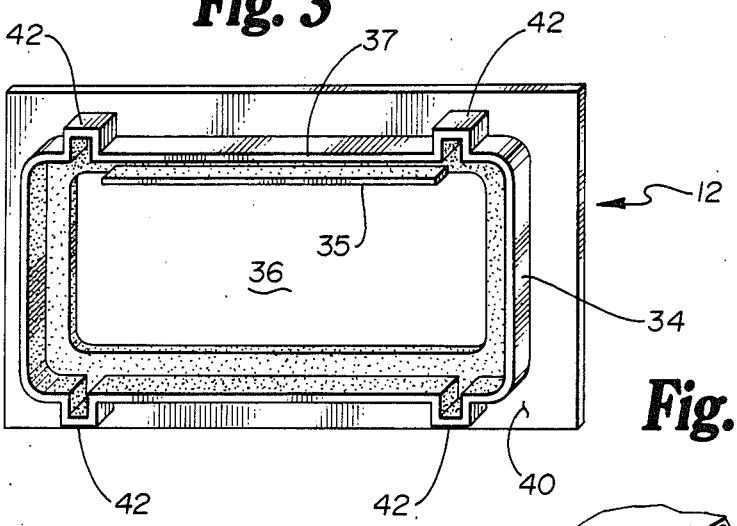
FIG. 3 shows a perspective view of the back surface of the front panel.

Referring now more particularly to FIGS. 2 and 3, a partially exploded view of cavity 10 and front panel 12 may be seen, showing more details of panel 12. In particular, panel 12 has a flange 34 surrounding the cavity access aperture 36. A front surface 38 of panel 12, seen most clearly in FIG. 1 is preferably flat for purposes of aesthetics and for providing a surface to cooperate with a microwave oven door to seal the energy in the cavity. A back surface 40 of front panel 12 similarly is generally planar. Flange 34 projecting substantially perpendicularly from back surface 40 preferably has a plurality of box-like portions 42 to accomodate the ends 44 of seams 14, 20. Panel 12 may also have a second flange or lip 35 parallel to the top portion 37 of flange 34. Lip 35 is spaced from portion 37 a distance to closely engage front edge 17 of top member 16. A similar lip may be provided on panel 12 for bottom member 22. Alternatively, as shown in FIG. 2, lips 35 may be omitted.

Figure 4:
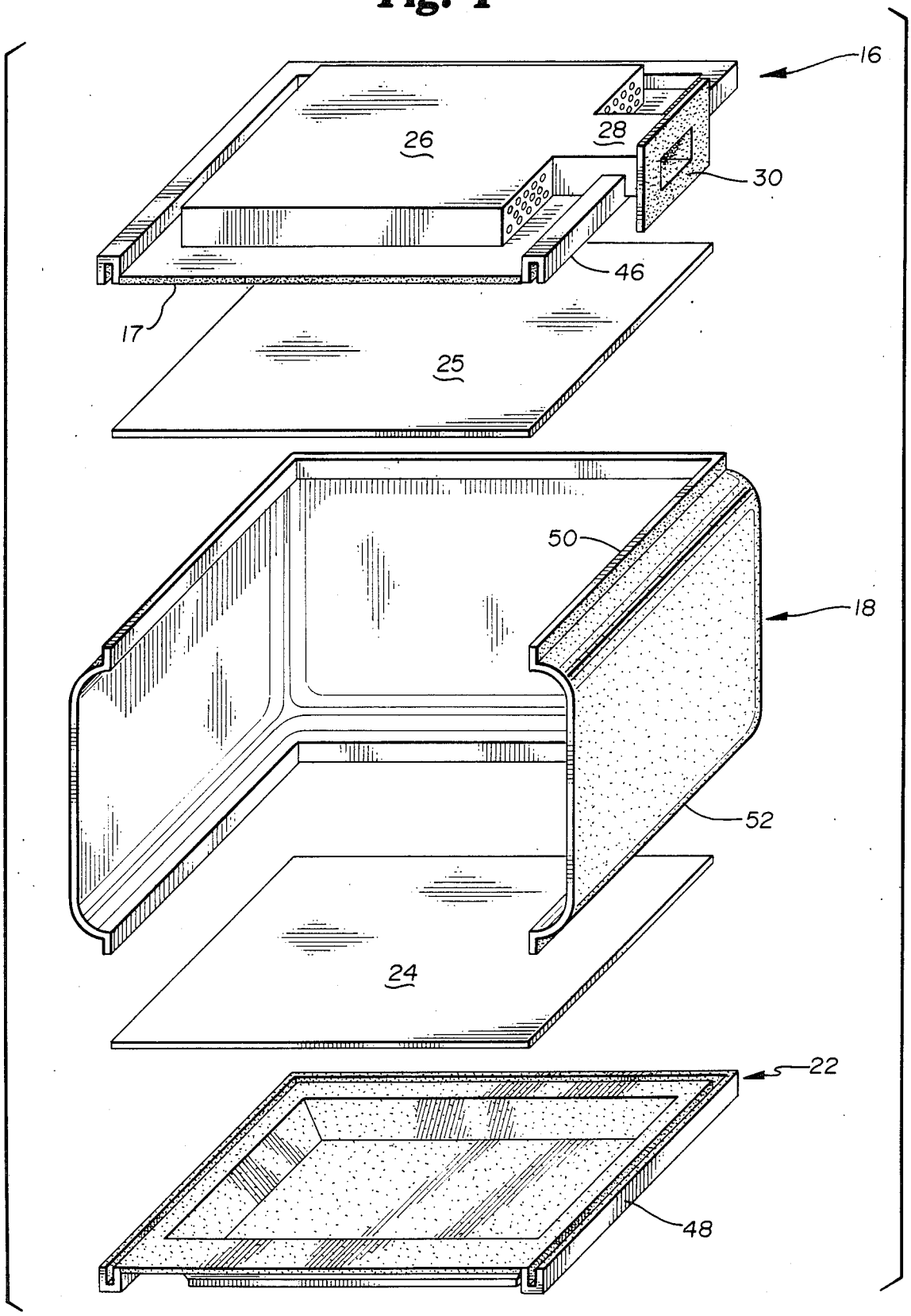
FIG. 4 shows an exploded view of the top, side wall, shelf and bottom members of the plastic microwave oven cavity.

Referring now more particularly to FIG. 4, an exploded view of the microwave oven cavity 10 may be seen in more detail. Members 16 and 22 preferably have grooves 46, 48 respectively, extending around a portion of their peripheries. Members 18 preferably has tongue portions 50, 52 extending about a corresponding portion of the periphery of the side wall member designed to mate with respective grooves 46, 48.

Referring now to FIGS. 2–5, the speckled shading indicates a coating on the plastic pieces which is impermeable to microwave energy. As may be seen, the coating is on the exterior of member 18, and on the interior of members 16 and 22. The coating is preferably within the flange of member 12 and may extend to either of front surface 38 or back surface 40 of front panel 12. If one or two lips 35 are provided, the coating is preferably extended to the groove formed by lip 35 and portion 37. It has been found desirable to place the microwave impermeable coating on the exterior of the side wall member to protect the coating from contact from within the microwave oven cavity during use to avoid abrasion and possible impairment of the microwave containment function of the coating. Members 16 and 22 may be coated on the interior surfaces since this microwave oven cavity construction provides for additional layers of material such as shelf 24 and cover member 25 to protect the microwave impermeable coating on members 16 and 22 from contact during microwave oven use.

It has been found that a polycarbonate plastic such as that sold as Lexan TM grade 940 by General Electric or an ABS plastic such as the KJW grade material offered by Borg-Warner may be used for the plastic microwave oven cavity assembly 10 and front panel member 12. Alternatively, various other plastics may be utilized for various properties such as rigidity, wear resistance and coating compatibility in molding the elements or members of this structure.

The microwave impermeable coating may be formed by utilizing the series 4700 tie coat (bond coat) and the 02Z arc spray zinc from TAFA, Inc., Dow Road, Bow, N.H. 03301-1157. Alternatively, a copper or nickel arc sprayed coating or another microwave impermeable coating, such as metallic paint or conductive ink may be utilized.

Figure 5:
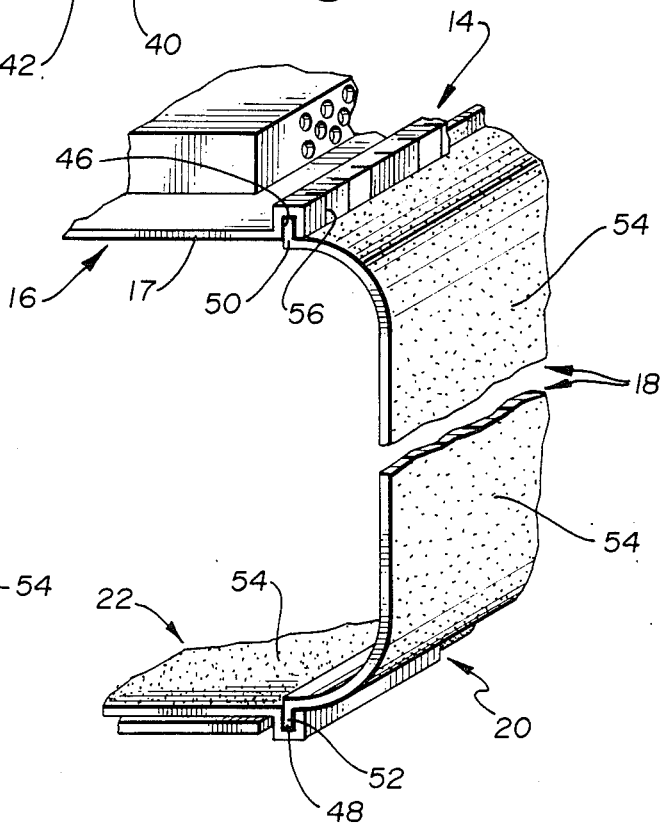
FIG. 5 shows a fragmented perspective view of the seams joining the top and bottom members to the side wall member.
Figure 6:
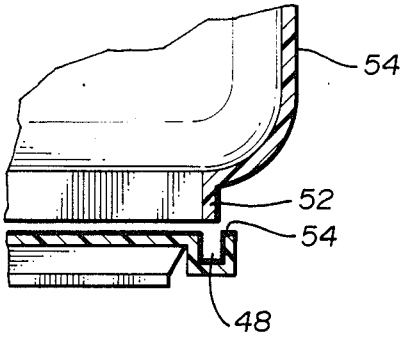
FIG. 6 shows an exploded view of details of the elements which form the seam between the side wall and bottom members.

Referring now more particularly to FIG. 5 and especially FIG. 6, the details of the seam construction may be seen. The microwave impermeable coating is shown as speckled shading 54 in FIG. 5 and as a heavy margin line 54 in FIG. 6. When tongue 52 is inserted into groove 48 the microwave impermeable coating is connected throughout seam 20 to prevent the escape of microwave energy from the interior of the microwave oven cavity. Joining tongue 50 to groove 46 results in a similar continuously microwave impermeable surface. Joining front panel 12 to cavity 10 extends the microwave impermeable surface to the region of the periphery of the cavity access aperture 36. Lip 35 may be utilized to maintain continuity of the coating between edge 17 of top member 16 and the top portion 37 of flange 34. Seam 14 is illustrated with optional transverse interruptions 56 in the portion forming groove 46. This results in individual fingers forming one side of groove 46 and will provide a more even load distrubution in the event of width irregularities in tongue 50. Seams 14, 20 and 21 may be secured by an appropriate adhesive or an "interfering" geometry for the mating surfaces such as matching indentations and projections or by frictional engagement. Still further alternatives are to provide separate fastening elements such as pins extending through the tongue and groove of seams 14 and 20 or to provide for appropriate geometries suitable for plastic welding or staking techniques.

The invention is not to be taken as limited to the details hereof as modifications and variations hereof may be made without departing from the spirit or scope of the invention.

What is claimed is:

1. A plastic microwave oven cavity assembly comprising:

(a) a top and a bottom generally pan-shaped member, each having a microwave impermeable coating on the interior thereof; and (b) a side wall member having a microwave impermeable coating on the exterior thereof;

wherein said top and bottom members are each joined to said side wall member by seam means for connecting the microwave impermeable coatings of said top, bottom and side wall members into a substantially continuously microwave impermeable surface sufficient to contain microwave energy within said cavity.

2. The assembly of claim 1 further comprising a plastic front wall member having:

(a) a front and a back surface;

(b) a cavity access aperture surrounded by a flange surface; and (c) a microwave impermeable coating on said flange surface and continued to at least one of said front and back surfaces such that the microwave impermeable surface is extended to the periphery of said cavity access aperture.

3. The assembly of claim 1 further comprising a microwave transparent shelf member secured above said bottom member and abutting said side wall member at its periphery such that contact with the microwave impermeable coating of said bottom member is prevented by said shelf member.

4. The assembly of claim 1 further comprising a microwave transparent cover member secured below said top pan-shaped member and abutting said side wall member at its periphery such that contact with the microwave impermeable coating of said top member is prevented by said cover member.

5. The assembly of claim 1 wherein said seam means comprises:

(a) groove means extending about a portion of the periphery of one of said pan-shaped members of said side wall member; and (b) tongue means extending about a corresponding portion of the periphery of the other of said pan-shaped members or said side wall member wherein said tongue means is adapted to be received in said groove means for mechanically joining said members together such that said microwave impermeable surface is maintained across said seam means.

6. The assembly of claim 1 wherein said side wall member comprises a generally U-shaped member forming left, right and rear side walls of said oven cavity.

7. The assembly of claim 1 wherein said top pan-shaped member further comprises a stirrer box having an inlet aperture for receiving energy from a microwave energy generator.

8. The assembly of claim 5 wherein said groove means further comprises retaining means for retaining said tongue means in said groove means.

* * * * *